US005708626A

United States Patent [19]

Hrubes

[11] Patent Number: 5,708,626

[45] Date of Patent: Jan. 13, 1998

[54] TRAJECTORY MEASUREMENT SYSTEM FOR UNDERWATER VEHICLES

[75] Inventor: J. Dana Hrubes, Newport, R.I.

[73] Assignee: The United States of America as represented by the Secretary of the Navy, Washington, D.C.

[21] Appl. No.: 775,233

[22] Filed: Dec. 30, 1996

[51] Int. Cl.[6] ..... B63G 8/00

[52] U.S. Cl. ..... 367/131

[58] Field of Search ..... 367/131, 133, 367/907, 908, 99; 114/330, 331; 364/424.025

[56] References Cited

U.S. PATENT DOCUMENTS 4,258,568 3/1981 Boetes et al. ..... 367/131

4,301,761 11/1981 Fry et al. ..... 114/331

5,283,767 2/1994 McCoy ..... 367/4

*Primary Examiner*—Daniel T. Pihulic

*Attorney, Agent, or Firm*—Michael J. McGowan; William F. Eipert; Prithvi C. Lall

[57] ABSTRACT

A system for determining the velocity and trajectory of an underwater vehicle comprises a data acquisition processor coupled to a plurality of sensors providing depth, heading, pitch and yaw data for the underwater vehicle. The acquisition processor collects data from the sensors, correlates and assembles the collected data into batches and processes the batches to determine vehicle velocity and trajectory of the vehicle relative to an earth-fixed coordinate system.

9 Claims, 4 Drawing Sheets

TRAJECTORY MEASUREMENT SYSTEM FOR UNDERWATER VEHICLES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a system for tracking an underwater vehicle. More specifically, the present invention relates to a self-contained system for an underwater vehicle to measure and record the velocity and trajectory of the vehicle relative to Earth-fixed coordinates.

(2) Description of the Prior Art

Several applications require an accurate record of the velocity and trajectory of an underwater vehicle. For example, an accurate record of vehicle trajectory and velocity is needed to evaluate the performance of vehicle guidance and control systems, to analyze the performance of vehicle body shapes and designs, to study acoustic emissions from the body of an underwater vehicle, and to assess the performance of contact tracking systems. Many of these applications could not be properly completed without obtaining an accurate record of vehicle trajectory and velocity. Furthermore, due to the size of unmanned underwater vehicles (UUVs) and the speed at which they travel, UUVs are difficult to track using conventional underwater range tracking systems.

While several self-contained, on-board systems for determining the trajectory and/or velocity of unmanned underwater vehicles are currently available, they generally suffer from one or more disadvantages which limit their use. Existing self-contained, on-board systems typically rely on the use of an inertial system or the use of accelerometers to record velocity and trajectory of the UUV. The concept behind inertial systems is relatively simple, although they are relatively complex to implement. Additionally, inertial systems tend to be very costly, heavy, and require a large amount of space. Although inertial systems are very accurate, the volume, weight, and cost of inertial systems tend to make the use of such systems prohibitive for measuring and recording the trajectory and velocity of underwater vehicles.

Systems which rely on accelerometers, such as that described in U.S. Pat. No. 4,258,568 to Boetes et al., obtain an acceleration vector by measuring the acceleration of the vehicle in three orthogonal directions. By integrating the acceleration, velocity and position as functions of time can be obtained. Measuring the acceleration vector with respect to magnetic north as well as measuring the depth of the vehicle, allows for accurate determination of vehicle velocity and trajectory. However, systems which rely on accelerometers typically are not well suited for applications in which a wide range of acceleration values are encountered. Many accelerometers cannot accurately measure large, sudden changes in acceleration and maintain the sensitivity required to measure small changes in the acceleration rate encountered when a vehicle is at a near constant velocity.

Other self-contained systems, such as that described in U.S. Pat. No. 3,738,164 to Sanford et al., infer velocity of a vehicle by measuring a varying electric potential induced as the vehicle travels through the earth's magnetic field.

However, the electromagnetic sensors used in such systems are not well suited for measuring high velocities associated with many underwater vehicles. Additionally, such electromagnetic sensors do not measure or record the vehicle position in space, and thus, such systems are not able to calculate the trajectory of the vehicle.

Systems which are not self-contained rely on a plurality of external inputs which limit the range in which and applications for which the underwater vehicle may be used. For example, the system described in U.S. Pat. No. 5,283,767 to McCoy uses a global positioning system (GPS) receiver to periodically determine the position of the vehicle. Such a system requires that the vehicle repeatedly breach the surface to obtain GPS data and cannot accurately determine the position of the vehicle between GPS readings.

Thus, what is needed is an inexpensive, self-contained system which can accurately measure and record the velocity and trajectory of an underwater vehicle relative to an earth based coordinate system, for vehicles that undergo both large, rapid and small, slow changes in acceleration.

SUMMARY OF THE INVENTION

Accordingly, it is a general purpose and object of the present invention to provide a system to determine the trajectory of an underwater vehicle.

Another object of the present invention is to provide a system which can continuously and accurately determine the velocity and trajectory of an underwater vehicle.

A further object of the present invention is the provision of a system to determine the velocity and trajectory of an underwater vehicle which undergoes both large, rapid changes and small, slow changes in acceleration.

It is a further object that the system of the present invention be small, light weight, and be relatively simple and inexpensive to implement.

These and other objects made apparent hereinafter are accomplished with the present invention by providing a data acquisition system coupled to a plurality of sensors which provide depth, heading, pitch and yaw data for the underwater vehicle. A pressure transducer measures depth, heading information is acquired from a magnetic compass and pitch and yaw data are obtained from tilt sensors. The acquisition system collects and records raw data from the sensors. The raw data is time correlated and processed to determine vehicle velocity and trajectory relative to an earth-fixed coordinate system.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DESCRIPTION OF THE PREFERRED EMBODIMENT

Figure 1:
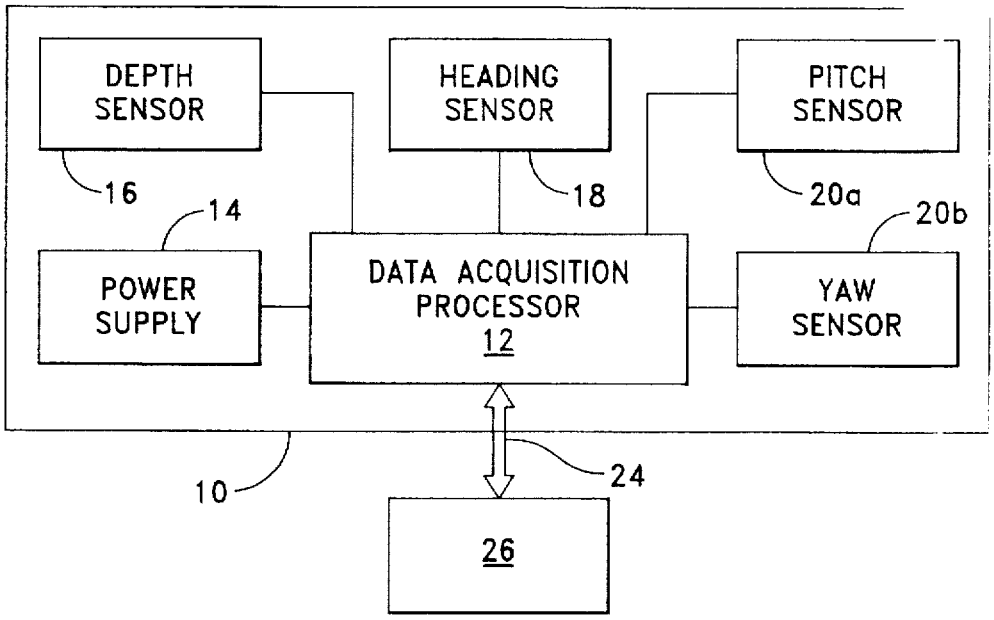
FIG. 1 is a block diagram of a trajectory measurement system for an underwater vehicle in accordance with the present invention.

Referring now to FIG. 1, there is shown a block diagram illustrating a trajectory measurement system for determining the velocity and trajectory of underwater vehicle 10 relative to Earth-fixed coordinates. The trajectory measurement system is mounted in a vehicle 10 for which velocity and trajectory information is desired. The system comprises a data acquisition processor 12 powered by a power supply 14 and coupled to receive data from pressure sensor 16, heading sensor 18 and two tilt sensors, pitch sensor 20*a* and yaw sensor 20*b*. Acquisition processor 12 collects data from the sensors, correlates and assembles the collected data into batches and processes the batches of data to determine vehicle velocity and trajectory. A communication interface 24 permits the recorded sensor data and/or trajectory information to be transferred to an external processor 26 for processing, display or evaluation. Furthermore, interface 24 can be used to load software into or reprogram acquisition processor 12. In a preferred embodiment, processor 12 and sensors 16, 18, 20*a* and 20*b* are located on-board vehicle 10 and processor 26 is remotely located off-board the vehicle. With such an embodiment, the processing of the sensor data to generate the velocity and trajectory of underwater vehicle 10 relative to earth fixed coordinates can be shared between processors 12 and 26.

Power supply 14 which can be a battery pack or similar device supplies the appropriate input power to acquisition processor 12 and sensors 16, 18, 20*a* and 20*b*. Alternatively, power can be provided to processor 12 and sensors 16, 18, 20*a* and 20*b* from a power source used by other systems aboard vehicle 10, such as from a power source for a sonar system or navigation control system.

Pressure sensor 16 senses the absolute pressure external to vehicle 10. The trajectory measurement system uses the absolute pressure data gathered by sensor 16 to determine and trace the depth of the underwater vehicle 10. Preferably sensor 16 comprises a plurality of pressure ports placed at several locations spaced around the circumference of vehicle 10 and connected to a pressure transducer by a common manifold to measure the pressure external to the vehicle. The pressure transducer can comprise a four-arm resistive strain gauge bridge diffused onto a silicon diaphragm. The pressure transducer can be mounted to pressure ports comprising a stainless steel housing filled with oil, which is separated from the measured fluid by a thin stainless steel membrane. It has been found that three pressure ports spaced circumferentially around the vehicle at approximately 120° increments provide an accurate measurement of the external pressure. To obtain an accurate measurement of vehicle velocity and trajectory, pressure sensor 16 preferably has an accuracy of at least ±0.5 percent of range and a resolution of 0.1 percent.

Figure 2:
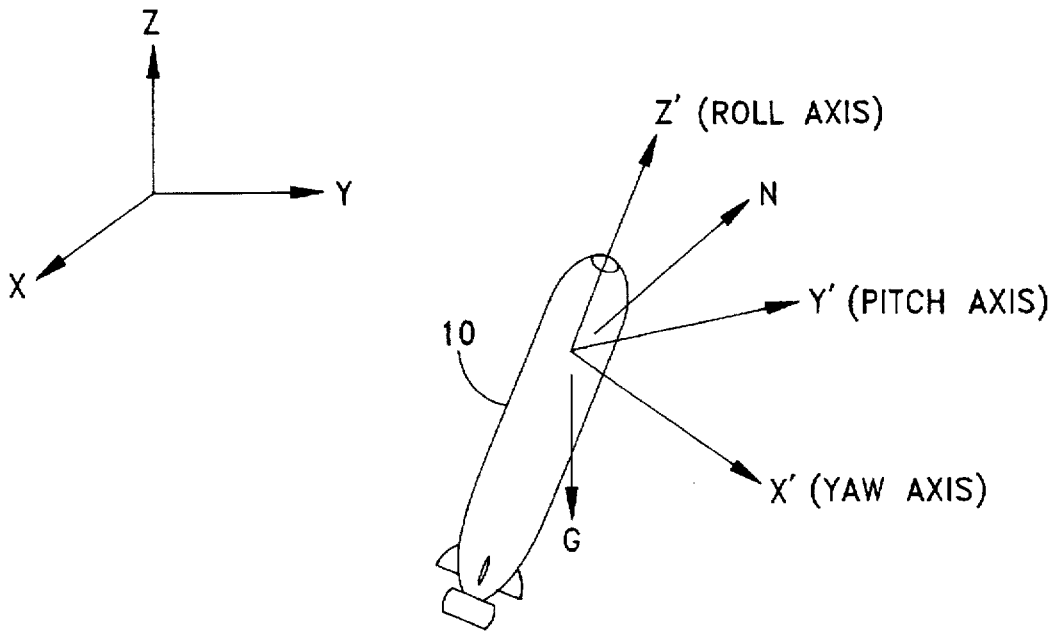
FIG. 2 shows the relationship of a vehicle-fixed three dimensional coordinate system to magnetic north.

Measurements from heading sensor 18 and tilt sensors 20*a* and 20*b* provide data that describe the position of vehicle 10 with respect to a vector, $\underline{N}$, pointing north and a vector, $\underline{G}$, parallel to the direction of gravity. The relationship of the vectors $\underline{N}$ and $\underline{G}$ to vehicle 10 is shown in FIG. 2. In FIG. 2, axes X', Y' and Z' define a coordinate system which is fixed with respect to vehicle 10, $\underline{N}$ defines a unit vector pointing north, and $\underline{G}$ defines a unit vector parallel to the direction of gravity. The X, Y, and Z axes define a coordinate system which is fixed with respect to the earth. Both $\underline{G}$ and $\underline{N}$ are fixed with respect to the earth. The data collected by sensors 18, 20*a* and 20*b* is used by processor 12 to relate the vehicle-fixed coordinate system (X',Y',Z') the Earth-fixed coordinate system (X,Y,Z) and determine the velocity and trajectory of vehicle 10.

Figure 3:
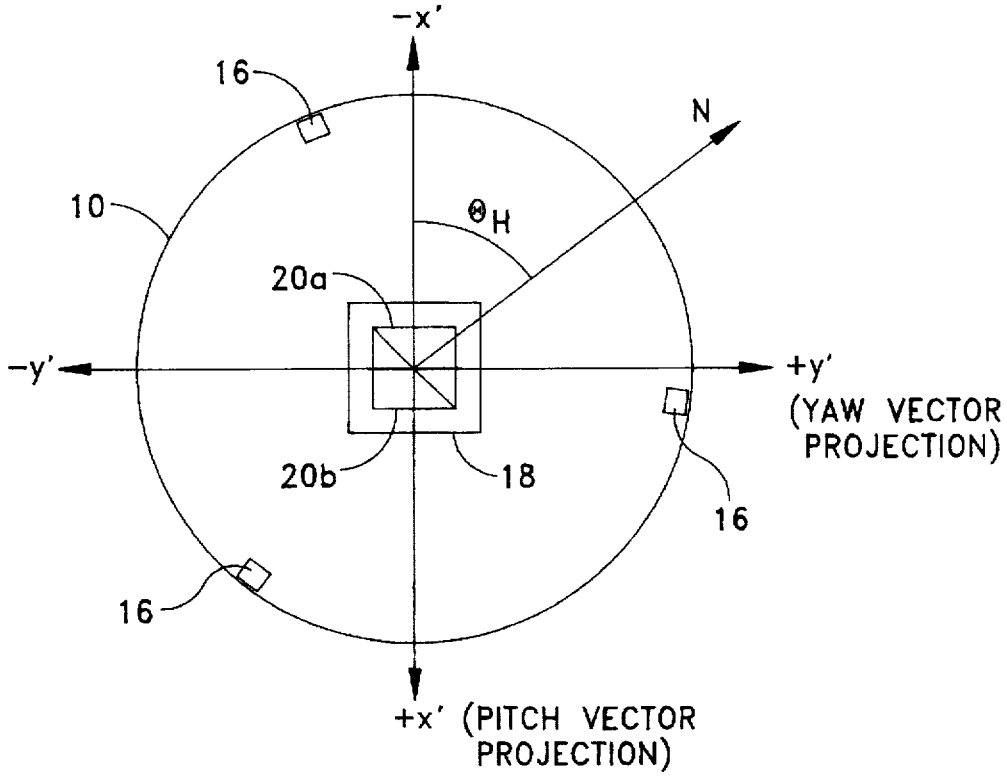
FIG. 3 shows the orientation of trajectory measurement system sensors with respect to a vehicle-fixed coordinate system.

FIG. 3 shows the orientation of pressure sensor 16, heading sensor 18 and tilt sensors 20*a* and 20*b* with respect to vehicle 10. Preferably, the trajectory measurement system is mounted in vehicle 10 such that the orthogonal axes of the system are substantially aligned with the orthogonal axes of the vehicle. Heading sensor 18, which can be a magnetic compass or the like, provides a measure of the position of vehicle 10 with respect to magnetic north. Sensor 18 provides acquisition processor 12 with a measure of the azimuthal direction of magnetic north about the vehicle roll axis (Z') relative to a vector projection of a vehicle tilt sensor. This is shown in FIG. 3 wherein sensor 18 provides the measure of angle $\Theta_H$ about the vehicle roll axis (Z') between the -X' projection on the X'–Y' plane and the magnetic north projection on the X'–Y' plane. However, as should be obvious to those skilled in the art, the measure magnetic north can be taken with respect to any vector and need not be limited to the -X' projection.

The active sensor within heading sensor 18 should be gimbaled such that the measurement will be accurate for any angle or orientation of vehicle 10. By gimbaled, it is meant that the sensor is mounted in a way such that the sensor will remain in a plane that is substantially perpendicular to the direction of gravity regardless of the motion of vehicle 10. Preferably, sensor 18 provides a range of 0° to 360° with an accuracy of ±0.5 percent of range, and a resolution of 0.1°.

Tilt sensors 20*a* and 20*b* each provide an angular measurement indicating the orientation of vehicle 10 about two mutually perpendicular axes. These two angles, pitch and yaw, are angles of the vehicle relative to the gravitational vector $\underline{G}$. The X' and Y' vectors shown in FIG. 3, which represent the vehicle reference frame, are actually the projections of the gravitational vector in the X' and Y' direction. Thus, the pitch and yaw angles are angles of the vehicle relative to the earth-fixed coordinate system.

Pitch sensor 20*a* measures the vehicle pitch angle, the angle about the Y'-axis, relative to gravitational vector $\underline{G}$. A zero pitch angle results when the projection of gravitational vector $\underline{G}$ on the vehicle X'–Y' plane is either zero or aligned with the yaw (X') axis. Yaw sensor 20*b* measures the vehicle yaw angle, the angle about the X'-axis relative to gravitational vector $\underline{G}$. A zero yaw angle results when the projection of $\underline{G}$ on the vehicle X'–Y' plane is either zero or aligned with the pitch (Y') axis. Tilt sensors 20*a* and 20*b*, which can comprise capacitance effect bubble sensors or the like, preferably have an accuracy of at least 0.10 for tilts of 0° to 5° with a resolution of 0.01°. Corrections for errors due to vehicle g-forces, particularly if there is a high acceleration phase, can be implemented using empirical corrections.

Figure 4:
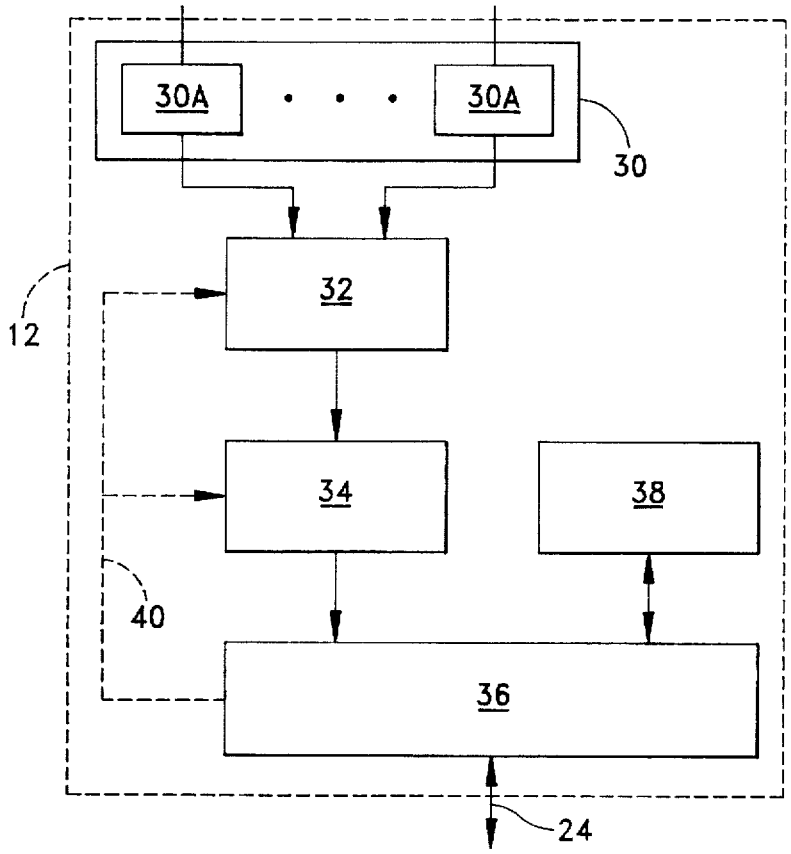
FIG. 4 is a block diagram of an embodiment of a data acquisition processor for use in a trajectory measurement system of the present invention.

Referring now to FIG. 4, there is shown a block diagram of an embodiment of data acquisition processor 12 for use in the trajectory measurement system of FIG. 1. In FIG. 4, acquisition processor 12 comprises a sensor interface 30, multiplexer 32, analog-to-digital (A/D) converter 34, trajectory processor 36, and memory 38.

Sensor interface 30 is coupled to receive sensor signals from sensors 16, 18, 20*a* and 20*b* (FIG. 1) and direct the signals to A/D converter 34. In one embodiment, interface 30 comprises a voltage reference and a sensor bridge 30A for each channel. In such an embodiment, each sensor bridge 30A measures the resistance of the corresponding sensor and converts this measurement to an appropriate analog voltage output. Interface unit 30 directs the analog output from each sensor bridge 30A to A/D converter 34 using multiplexer 32. The output of multiplexer 32 can be sent to converter 34 through a gain and/or offset circuit (not shown) to condition the signals and utilize the entire range of A/D converter 34. The operation of converter 34 and multiplexer 32 can be controlled and modified by trajectory processor 36 through control signals 40.

Converter 34 digitizes the signals received from multiplexer 32 to generate a single time series digital data stream comprising multiplexed samples of depth, heading, pitch and yaw sensor data. The digital samples from converter 34 are passed to processor 36 which groups the data samples by type and time correlates the data.

Processor 36 receives and demultiplexes the input data stream, grouping the digital samples as either depth, heading or tilt data. Processor 36 time correlates the data such that the sensor data can be tracked and related to one another over a common time domain. The correlated data is then stored in memory 38. Preferably, processor 36 oversamples (averages) a number of data samples for each sensor before storing the data. The number of samples averaged is based upon the expected rate of change of the data and upon the consistency and accuracy of instantaneous data samples. Alternatively, the correlated data can be transferred to external processor 26 (FIG. 1) through communication interface 24 for processing rather than being stored in memory. For example, external processor 26 can be located on a vessel launching vehicle 10 and the sensor data can be transferred from vehicle 10 to launching vessel through a conductive wire, a fiber optic connection or the like.

Figure 5A:
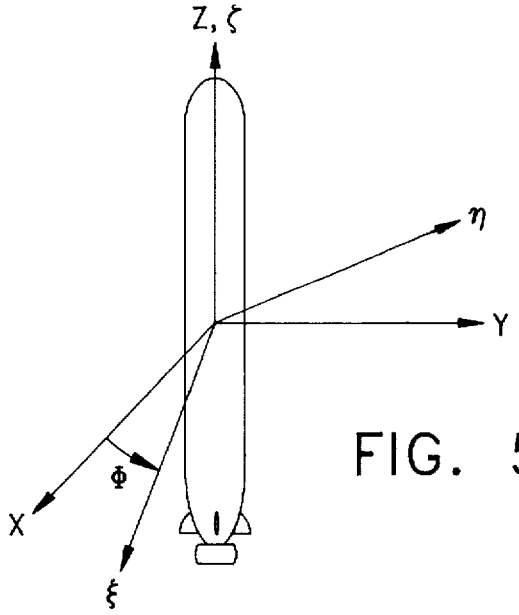
FIGS. 5A, 5B and 5C illustrate how Eulerian angles relate Earth-fixed coordinates to vehicle-fixed coordinates.
Figure 5B:
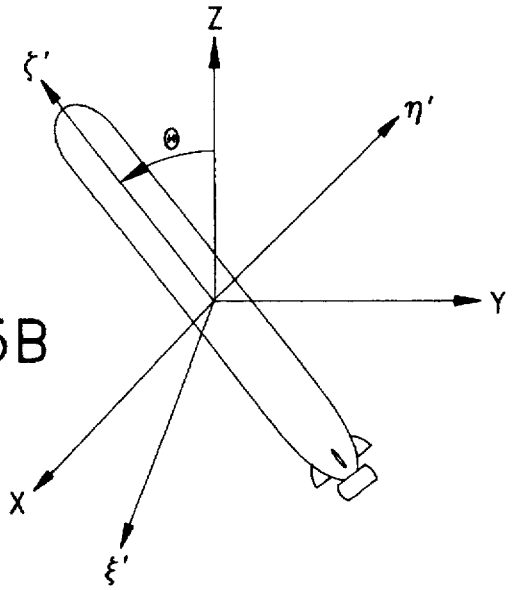
Figure 5C:
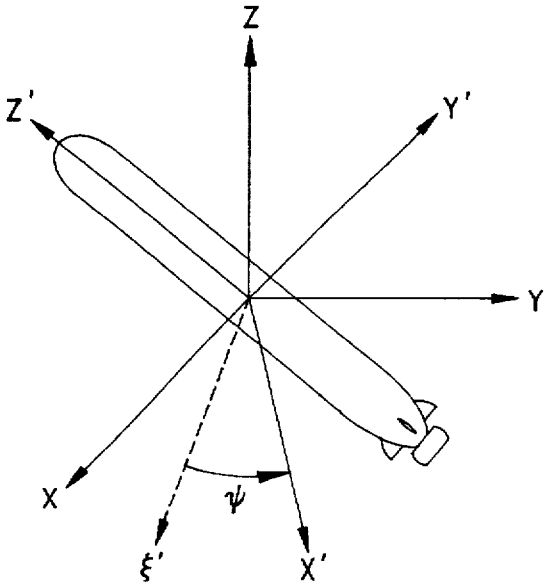

The processing to determine vehicle velocity and trajectory from the sensor data can be performed by acquisition processor 12, external processor 26 or shared between the two. Vehicle velocity and trajectory is determined by using equations which relate vehicle-based Euler angles to the Earth-fixed coordinate system. The Earth-fixed coordinate system X,Y,Z (FIG. 2) is related to the vehicle-fixed coordinate system X',Y',Z' by a rotation determined by Euler angles $\phi$, $\theta$, and $\psi$ as shown in FIGS. 5A–5C. In FIG. 5A, the Earth-fixed X,Y,Z axes are rotated about the Z-axis by angle $\phi$, resulting in the $\xi$, $\eta$, $\zeta$ axes. FIG. 5B shows the rotation of the $\xi$, $\eta$, $\zeta$ axes about the $\xi$-axis by angle $\theta$ to yield the $\xi'$, $\eta'$, $\zeta'$ axes. FIG. 5C shows the rotation of the $\xi'$, $\eta'$, $\zeta'$ axes about the $\zeta'$-axis by angle $\psi$ to yield the X',Y',Z' axes.

Figure 6:
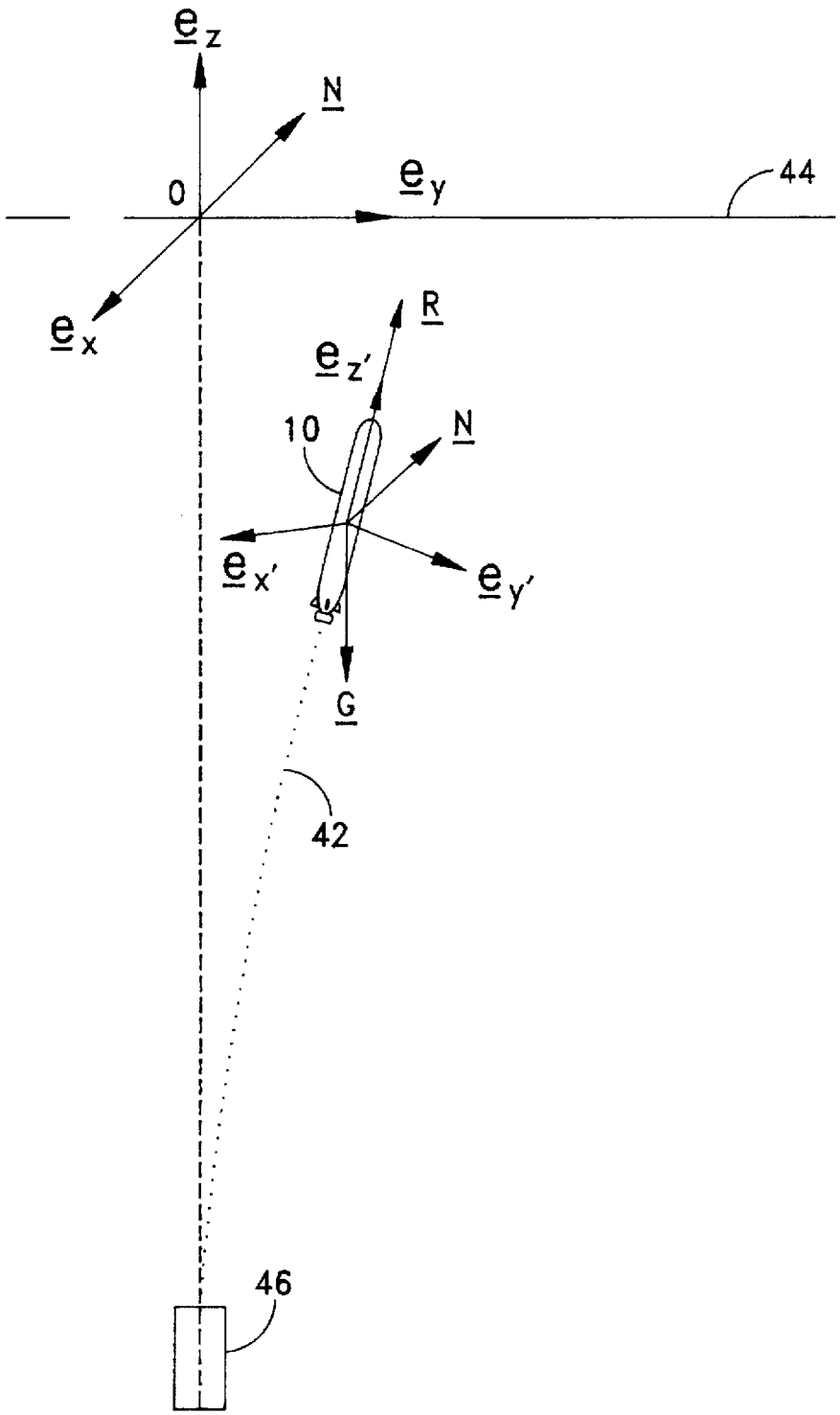
FIG. 6 illustrates the geometry used to relate a vehicle-fixed coordinate system to an Earth-fixed coordinate system.

The equations which relate vehicle-based Euler angles to the Earth-fixed coordinate system will be developed with reference to FIG. 6 which illustrates the geometry for an underwater vehicle 10 following a trajectory 42 as it rises toward the surface 44 of the water. In FIG. 6, vehicle 10 which can be a buoyant freely rising vehicle or a vehicle subject to an internal and/or external propulsion device or the like. Some assumptions concerning the motion of vehicle 10 during ascent are necessary to reconstruct vehicle trajectory 42 from the sensor readings. One assumption is that pressure sensor 16 accurately and instantaneously measures the undisturbed hydrostatic pressure and, therefore, vehicle depth. A second assumption is that the vehicle angle of attack is zero during ascent. A further assumption is that no transverse motion of the vehicle exists (that is, no influence due to ocean currents or the like).

The equations relating vehicle-based Euler angles to the Earth-fixed coordinate system can be determined by letting $\underline{e}_x$, $\underline{e}_y$, $\underline{e}_z$ define an earth-fixed basis set and $\underline{e}_{x'}$, $\underline{e}_{y'}$, $\underline{e}_{z'}$ be a basis set fixed to vehicle 10 such that $\underline{e}_{z'}$ is coincident with the roll (Z') axis. Preferably, the origin of earth-fixed basis set $\underline{e}_x$, $\underline{e}_y$, $\underline{e}_z$ is fixed to be substantially at the water surface 44 and to be substantially aligned with the location 46 of launch (release) of vehicle 10. If $\underline{N}$ defines a unit vector pointing north, and $\underline{G}$ defines a unit vector parallel to the direction of gravity, then $$\underline{G}=G_1\underline{e}_X+G_2\underline{e}_Y+G_3\underline{e}_Z=G'_1\underline{e}_{X'}+G'_2\underline{e}_{Y'}+G'_3\underline{e}_{Z'} \tag{1}$$

and $$\underline{N}=N_1\underline{e}_X+N_2\underline{e}_Y+N_3\underline{e}_Z=N'_1\underline{e}_{X'}+N'_2\underline{e}_{Y'}+N'_3\underline{e}_{Z'}. \tag{2}$$

The objective is to find $\underline{e}_{X'}$, $\underline{e}_{Y'}$, $\underline{e}_{Z'}$ relative to $\underline{e}_X$, $\underline{e}_Y$, $\underline{e}_Z$.

The tilt sensors 20*a* and 20*b* measure the angle $\alpha$ between $\underline{e}_{X'}$ and $\underline{G}$ and the angle $\beta$ between $\underline{e}_{Y'}$ and $\underline{G}$. The relationship between the angles $\alpha$ and $\beta$ and vector $\underline{G}$ is given by $$\cos(\alpha)=\underline{e}_{X'}\cdot\underline{G} \tag{3}$$

$$\cos(\beta)=\underline{e}_{Y'}\cdot\underline{G} \tag{4}$$

or $$\underline{G}=\cos\alpha\underline{e}_{X'}+\cos\beta\underline{e}_{Y'}+G_3'\underline{e}_{Z'} \tag{5}$$

Heading sensor 18 yields a unit vector $\underline{m}$ that is a projection of $\underline{N}$ on the X',Y' plane that is given by $$\underline{m}=\frac{N'_1\underline{e}_{X'}+N'_2\underline{e}_{Y'}}{(N'^2_1+N'^2_2)^{1/2}} \tag{6}$$

Thus, sensors 20*a*, 20*b* and 18 measure $G'_1$, $G'_2$ and $N'_1/N'_2$ ($N'_1/N'_2$ is obtained because $\underline{m}$ is a unit vector). Multiplying equation (1) by $\underline{e}_{X'}$ and $\underline{e}_{Y'}$ yields the following equations:

$$G'_1=G_1\underline{e}_X\cdot\underline{e}_{X'}+G_2\underline{e}_{Y'}\cdot\underline{e}_{X'}+G_3\underline{e}_{Z'}\cdot\underline{e}_{X'} \tag{7a}$$

$$G'_2=G_1\underline{e}_X\cdot\underline{e}_{Y'}+G_2\underline{e}_{Y'}\cdot\underline{e}_{Y'}+G_3\underline{e}_{Z'}\cdot\underline{e}_{Y'}. \tag{7b}$$

Similarly, if equation (2) is multiplied by $\underline{e}_{X'}$ and $\underline{e}_{Y'}$, the following expressions are obtained:

$$N'_1=N_1\underline{e}_X\cdot\underline{e}_{X'}+M_2\underline{e}_{Y'}\cdot\underline{e}_{X'}+N_3\underline{e}_{Z'}\cdot\underline{e}_{X'} \tag{8a}$$

$$N'_2=N_1\underline{e}_{X'}\cdot\underline{e}_{Y'}+N_2\underline{e}_{Y'}\cdot\underline{e}_{Y'}+N_3\underline{e}_{Z'}\cdot\underline{e}_{Y'}. \tag{8b}$$

Dividing equation (8a) by (8b) gives $$\left(\frac{N'_1}{N'_2}\right)(N_1\underline{e}_X\cdot\underline{e}_{Y'}+N_2\underline{e}_Y\cdot\underline{e}_{Y'}+N_3\underline{e}_Z\cdot\underline{e}_{Y'})=N_1\underline{e}_X\cdot\underline{e}_{X'}+N_2\underline{e}_Y\cdot\underline{e}_{X'}+N_3\underline{e}_Z\cdot\underline{e}_{X'} \tag{8c}$$

The transformation by rotation only between two Cartesian coordinate systems has the form $X'_i=A_{ij}X_j$ where $A_{ij}=e_{i'}\cdot e_j$ are the direction cosines and are given as:

$$A_{ij}=\begin{bmatrix}\alpha_1 & \alpha_2 & \alpha_3\\ \beta_1 & \beta_2 & \beta_3\\ \gamma_1 & \gamma_2 & \gamma_3\end{bmatrix} \tag{9}$$

where the nine direction cosines must satisfy the restriction $\alpha_i\alpha_j+\beta_i\beta_j+\gamma_i\gamma_j=\delta_{ij}$ for all i=(1,2,3), j=(1,2,3) where $\delta_{ij}$={1 for i=j, 0 for i≠j} is the Kronecker delta. The matrix $A_{ij}$ is related to the Euler angles $\theta$, $\phi$, $\psi$ of the vehicle as follows:

$$A_{ij} = \begin{bmatrix} \cos\psi\cos\phi - \cos\theta\sin\phi\sin\psi & \cos\psi\sin\phi + \cos\theta\cos\phi\sin\psi & \sin\psi\sin\theta \\ \sin\psi\cos\phi - \cos\theta\sin\phi\cos\psi & -\sin\psi\sin\phi + \cos\theta\cos\phi\cos\psi & \cos\psi\sin\theta \\ \sin\theta\sin\phi & -\sin\theta\cos\phi & \cos\theta \end{bmatrix} \quad (10)$$

Thus, only three unknowns ($\theta$, $\phi$, $\psi$) exist for the determination of $A_{ij}$.

Using the direction cosines given in equation (9) for the rotation between two Cartesian coordinate systems, equations (7a), (7b) and (8c) can be rewritten as:

$$G'_1=G_1\alpha_1+G_2\alpha_2+G_3\alpha_3, \quad (11)$$

$$G'_2=G_1\beta_1+G_2\beta_2+G_3\beta_3 \quad (12)$$

and $$\left(\frac{N'_1}{N'_2}\right)(N_1\beta_1+N_2\beta_2+N_3\beta_3)=N_1\alpha_1+N_2\alpha_2+N_3\alpha_3. \quad (13)$$

The cosines $\alpha_1$, $\alpha_2$, $\alpha_3$, $\beta_1$, $\beta_2$ and $\beta_3$ in equations (11)–(13) can be related to angles $\theta$, $\phi$, $\psi$ by the expressions in equation (10). Using the relationships in equation (10), the following measured values for $G'_1$, $G'_2$, $m'_1$ and $m'_2$ obtained from sensors 20a, 20b and 18:

$$G'_1=\sin(\theta_{Xt}) \quad (14)$$

$$G'_2=\sin(\theta_{Yt}) \quad (15)$$

$$m'_1=\cos(\Theta_J) \quad (16)$$

$$m'_2=\sin(\Theta_H) \quad (17)$$

where $\theta_{Xt}$ is the X-axis tilt, $\theta_{Yt}$ is the Y-axis tilt, $\Theta_H$ is the heading (0° =North), and the orienting the Earth-fixed coordinates such that $\underline{G}=\underline{e}_Z$ and $\underline{N}=\underline{e}_X$, equations (11)–(13) can be used to determine angles $\theta$, $\phi$, $\psi$ using the following equations:

$$\sin(\theta_{Xt})=\sin\psi\sin\theta, \quad (18)$$

$$\sin(\theta_{Yt})=\cos\psi\sin\theta, \quad (19)$$

and $$\cos(\Theta_H)(-\sin\psi\cos\phi-\cos\theta\sin\phi\cos\psi)=\sin(\Theta_H)(\cos\psi\cos\phi-\cos\theta\sin\phi\sin\psi). \quad (20)$$

Equations (18)–(20) can be solved to yield the following expressions to determine the three Euler angles $\theta$, $\phi$, $\psi$:

$$\sin\theta=\sin(\theta_{Yt})\left[1+\frac{\sin^2\theta_{Xt}}{\sin^2\theta_{Yt}}\right]^{1/2} \quad (21)$$

$$\tan\phi=\frac{\sin\Theta_H+\psi}{\cos\theta(\sin\psi-\cos\psi)} \quad (22)$$

and $$\tan\psi=\frac{\sin\theta_{Xt}}{\sin\theta_{Yt}} \quad (23)$$

For vehicle trajectories with tilt angles of less than 10° several assumptions can be made to simplify the Euler angle relations given in equations (21)–(23). If it can be assumed that $\theta_{Xt}<<\pi/2$, $\theta_{Yt}<<\pi/2$, $\theta<<\pi/2$ and $\phi$, $\psi$ and $\Theta_H$ are arbitrary, then equations (18)–(20) can be rewritten as:

$$\theta_{Xt}=\theta\sin\psi, \quad (18a)$$

$$\theta_{Yt}=\theta\cos\psi, \quad (19a)$$

and $$\tan(\Theta_H)=-\tan(\phi+\psi). \quad (20a)$$

Solving equations (18a)–(20a) yields the following simplified expressions to determine the Euler angles $\theta$, $\phi$, $\psi$:

$$\theta=\frac{\theta_{Xt}}{\sin\psi} \quad (21a)$$

$$\tan(\phi+\psi)=\tan\Theta_H \quad (22a)$$

and $$\tan\psi=\frac{\theta_{Xt}}{\theta_{Yt}} \quad (23a)$$

Once the values of angle $\theta$, $\phi$, $\psi$ are known, they can be substituted back into the direction cosine matrix $A_{ij}$ given in equation (10) to determine the X',Y',Z' coordinates as given by:

$$X'=A_{11}X+A_{12}Y+A_{13}Z,$$
$$Y'=A_{21}X+A_{22}Y+A_{23}Z, \quad (24)$$
$$Z'=A_{31}X+A_{32}Y+A_{33}Z$$

Having determined the relationship of the vehicle-based Euler angles to the Earth-fixed coordinate system, the velocity and trajectory of vehicle 10 can be determined. If $\underline{R}$ denotes a unit vector, which is always oriented along the roll (Z') axis, attached to the center of mass of vehicle 10, then in terms of the Earth fixed system (X, Y, Z)

$$\underline{R}=R_1\underline{e}_X+R_2\underline{e}_Y+R_3\underline{e}_Z=\underline{e}_{Z'} \quad (25)$$

where, in terms of the direction cosine matrix $A_{ij}$, $$R_1=A_{31},\ R_2=A_{32},\ \text{and}\ R_3=A_{33}. \quad (26)$$

The position of the center of mass of vehicle 10 with respect to the origin of the Earth-fixed system is given by the position vector $\underline{C}$ as $$\underline{C}=C_1\underline{e}_X+C_2\underline{e}_Y+C_3\underline{e}_Z \quad (27)$$

If the origin of the Earth-fixed system is fixed to the water surface 44, then $C_3$ is the depth of the center of mass. The value of $C_3$ at any given time is obtained from sensor 16. Given the position $\underline{C}$ of the center of mass of vehicle 10, the velocity $\underline{V}$ of the vehicle is given by:

$$V=\frac{dC}{dt}=\frac{dC_1}{dt}\underline{e}_X+\frac{dC_2}{dt}\underline{e}_Y+\frac{dC_3}{dt}\underline{e}_Z \quad (28)$$

If it is assumed that $\underline{V}$ is always parallel to $\underline{R}$ (that is, no transverse motion of vehicle 10 exists), then $\underline{V}=c_p\underline{R}$ where $c_p$ is a proportionality constant. Assuming no transverse motion exists (the velocity $\underline{V}$ is always parallel to $\underline{e}_{Z'}$), equations (25) and (28) can be combined to give the following set of equations:

$$\frac{dC_1}{dt}=c_pR_1$$
$$\frac{dC_2}{dt}=c_pR_2 \quad (29)$$
$$\frac{dC_3}{dt}=c_pR_3$$

Because $C_3$ and $dC_3/dt$ can be determined from the readings taken by sensor 16 and $R_3$ is given by the direction cosine matrix, $c_p$ is given by $$c_p = \frac{dC_3/dt}{R_3},$$

which yields $$\frac{dC_1}{dt} = \left(\frac{dC_3\sqrt{dt}}{R_3}\right)R_1, \quad (30)$$

$$\frac{dC_2}{dt} = \left(\frac{dC_3/dt}{R_3}\right)R_2$$

The expressions given by equation (30) can be numerically integrated using processor 12, processor 26, or a combination thereof to obtain the remaining components ($C_1$ and $C_2$) of the vehicle position vector. To numerically integrate the expressions given in equation (30), three terms in the direction cosine matrix, show in equation (26), must be determined.

In operation, underwater vehicle 10 is launched and pressure sensor 16, heading sensor 18 and two tilt sensors 20*a* and 20*b* begin collecting data. Sensors 16, 18, 20*a* and 20*b* provide continuous analog data streams to acquisition processor 12. Typically, processor 12 contains multiple ports for receiving the sensor data. Processor 12 receives the multiple analog data streams and builds a single output digital data stream. In building the data stream, processor 12 converts the input data from analog to digital format and multiplexes the data to form a single digital data stream. The digital data stream is received by trajectory processor 36 which oversamples the data for each sensor and time correlates the data such that the sensor data samples can be tracked and related to one another over a common time domain. The data is then processed to determine the velocity and trajectory of vehicle 10.

The data can be processed using trajectory processor 36 located on board vehicle 10. With such an arrangement, the velocity and trajectory for vehicle 10 can be downloaded for display or further processing using communication interface 24 for display or further processing during the mission or after the vehicle 10 has completed its mission. Optionally, the time correlated sensor data can processed to determine the velocity and trajectory of vehicle 10 using an external processor. The correlated data can be downloaded either while vehicle 10 is traveling or after it has concluded its run.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A trajectory measurement system for an underwater vehicle comprising:

a depth sensor for measuring depth of the vehicle and generating a depth sensor signal, said depth sensor signal indicating depth of the vehicle;

a heading sensor for measuring an angular heading with respect to a reference point and generating a heading sensor signal indicating said angular heading;

a tilt sensor for sensing orientation of the vehicle about two mutually perpendicular axes and generating a tilt sensor signal; and an acquisition processor, responsive to said depth sensor signal, said heading sensor signal and said tilt sensor signal, for determining vehicle velocity and vehicle trajectory.

2. The system of claim 1 wherein said acquisition processor comprises:

a sensor interface, coupled to receive said depth sensor signal, said heading sensor signal and said tilt sensor signal, for generating a multiplexed digital sensor signal; and a trajectory processor, responsive to said multiplexed digital sensor signal, for generating said vehicle trajectory and said vehicle velocity.

3. The system of claim 2 wherein said sensor interface comprises:

a plurality of sensor bridges, each sensor bridge being connected across one of said depth sensor, said heading sensor and said tilt sensor for measuring a resistance of said sensor and converting said resistance to an analog voltage;

a multiplexer, coupled to receive said analog voltage from each one of said plurality of sensor bridges, for periodically passing the analog voltage from one of said plurality of sensor bridges; and a converter, coupled to said multiplexer, for generating said multiplexed digital sensor signal.

4. The system of claim 3 wherein said depth sensor comprises a plurality of pressure ports spaced circumferentially around said vehicle.

5. The system of claim 3 wherein said heading sensor comprises a gimbaled magnetic compass.

6. The system of claim 3 wherein said tilt sensor comprises a capacitance effect bubble sensor.

7. The system of claim 2 wherein said depth sensor comprises a plurality of pressure ports spaced circumferentially around said vehicle.

8. The system of claim 2 wherein said heading sensor comprises a magnetic compass.

9. The system of claim 2 wherein said tilt sensor comprises at least two capacitance effect bubble sensors.

* * * * *